US005161197A

United States Patent [19]

Griesinger

[11] Patent Number: 5,161,197

[45] Date of Patent: Nov. 3, 1992

[54] ACOUSTIC ANALYSIS

[75] Inventor: David H. Griesinger, Cambridge, Mass.

[73] Assignee: Lexicon, Inc., Waltham, Mass.

[21] Appl. No.: 787,532

[22] Filed: Nov. 4, 1991

[51] Int. Cl.[5] ..... H04R 29/00; H04R 5/027

[52] U.S. Cl. ..... 381/56; 381/26

[58] Field of Search ..... 381/1, 26, 92, 56, 63

[56] References Cited

U.S. PATENT DOCUMENTS

| | | | |
|---|---|---|---|
| 3,626,365 | 12/1971 | Press | 381/92 |
| 4,135,203 | 1/1979 | Friedman | 381/1 |
| 5,029,216 | 2/1991 | Jhabvala et al. | 381/26 |

OTHER PUBLICATIONS

Bradley, Contemporary Approaches to Evaluation Auditorium Acoustics, AES 8th International Conference, pp. 59–69.

*Primary Examiner*—Forester W. Isen

*Attorney, Agent, or Firm*—Fish & Richardson

[57] ABSTRACT

A process for evaluating spatial impression of an enclosed space includes the steps of generating output signals as a function of fluctuating sound pressure at two points spaced about one-quarter meter apart, band limiting the output signals to a pass band of less than about one octave, generating fluctuating signals that represent amplitude information of the band limited output signals, band limiting the fluctuating amplitude information signals to a pass band of about five hertz to thirty hertz, and comparing the band limited fluctuating amplitude information signals to provide an indication of the spatial impression of the enclosed space.

20 Claims, 1 Drawing Sheet

ACOUSTIC ANALYSIS

Figure 1:
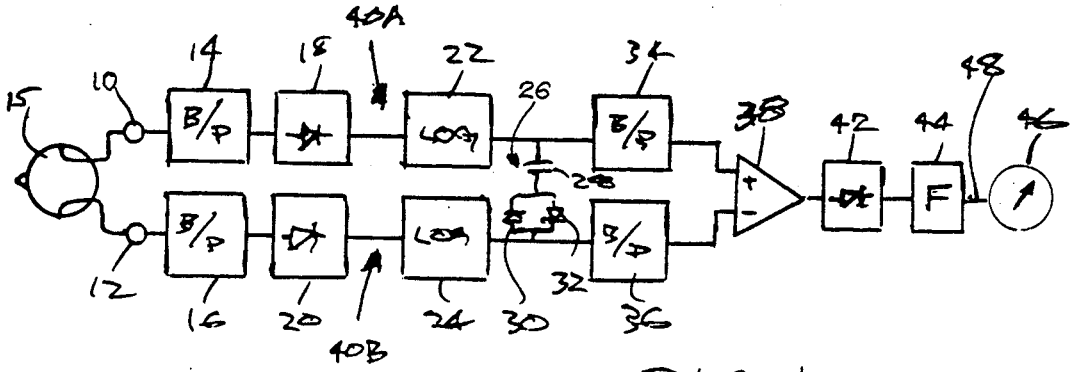

This invention relates to acoustic analysis and more particularly to measurement of spatial impressions.

Sound inside an enclosed space travels from its source to a listener both directly and through a great variety of reflected paths. It is the nature of these reflected paths which determines the usefulness of the space for activities which require sound. For example designers of rooms used for speech attempt to maximize speech intelligibility through limiting the energy in reflections with long time delays. Rooms used for music performance in general require more energy at long delay times.

Sabine developed the concept of the reverberation time of a room as a measure of the suitability of that room for a variety of purposes, either for speech of music. The Sabine reverberation time (RT) is simply found by determining the time it takes for a sound which ceases abruptly to decay −60 dB in intensity. In general rooms which have RT values less than one second are good for speech, and rooms with decays greater than 1.6 seconds are good for music.

There are many exceptions to Sabine's measure. Rooms with equal RT values can sound very different, and be unexpectedly appropriate or inappropriate for a given use. In the 100 years since Sabine many different acoustic measures have been proposed to try to predict the properties of rooms with more precision. In the domain of speech intelligibility various physical measures have been developed which have been successful in objectively measuring the degree of intelligibility which a room will actually achieve when measured with a nonsense syllable test. The situation is considerably less happy when it is desired to measure the suitability of a space for music.

Current measures for musical acoustics are summarized in Bradley. These include four measures of importance: RT, Clarity (C80), gain (G), and lateral fraction (LF) or interaural cross correlation (IACC). IACC is found by cross correlating the two output signals from a dummy head microphone. If $L_{(t)}$ is the left output and $R_{(t)}$ is the right output:

$$IACC = 2\frac{\int_{-\infty}^{+\infty}(L_{(t)}R_{(t)})dt}{\int_{-\infty}^{+\infty}(L_{(t)}^2 + R_{(t)}^2)dt} =$$

As Bradley points out, these measures seem to have some relationship to musical acoustics. Unfortunately just what relationship is far from clear. Once again, rooms can be found which measure identically and yet have very different musical properties and desirability.

Barron (e.g., "The Subjective Effects of First Reflections", J. Sound Vib. Vol. 15, 475–494 (1971)) found that there is an important sensation associated with musical acoustics, which he named spatial impression (SI). Barron showed that SI is a large part of a music listener's preference in different halls. At the same time that Barron was publishing this work, Schroeder, (e.g., "Comparative Study of European Concert Halls: Correlation of Subjective Preference with Geometric and Acoustic Parameters", J. Acoust. Soc. Am., Vol. 56, 1195–1201, (1974)) was making dummy head recordings in various concert halls and then comparing them back in the laboratory. He also found that SI was a significant predictor of hall preference. Schroeder chose to relate SI to the IACC of his binaural tapes, and since this time, and especially through the writings of Ando, (e.g., "Concert Hall Acoustics", Springer-Verlar, Berlin, (1985)), the IACC has been used as a hall measure.

In an attempt to quantify SI from measurements of the impulse response of rooms, the measure called Lateral Fraction (LF) was developed. LF is defined as the integral of the lateral reflected energy as measured by a sideways facing figure of eight microphone, divided by the integral of the total energy (as measured by an omni microphone). The integral for the lateral starts at ten milliseconds after the direct sound, and continues to eighty milliseconds after the direct sound, and the integral for the total energy is similar, but integrates the direct sound also, starting at zero milliseconds and extending to the complete reverberation time. Both LF and IACC have proven to be extremely unreliable measures for SI. LF as currently used simply does not integrate for long enough to be at all useful, and IACC contradicts angular dependance of SI as found by Barron. In addition, the IACC is not always a positive value as reflections from some angles and at some frequencies produce negative IACC's.

The invention provides an indication of spatial impression (the way a room sounds) by measuring fluctuation in relative interaural levels. In accordance with one aspect of the invention, there is provided spatial impression apparatus that includes two channels. Each channel has a microphone input, the microphones being spaced about one-quarter meter apart. A dummy head microphone with pinnae may be used if desired in particular applications. Each channel includes a band pass filter of less than about one octave pass band and the channels are connected to comparison circuitry and the resulting output is applied to an appropriate device such as a meter or recorder.

In a particular embodiment, each channel includes a one-third octave band pass filter, a rectifier, a log amplifier, and a second band pass filter with an upper limit of about thirty hertz; those two channels are then compared, the comparison circuitry being a subtractor in particular embodiments in which interaural level ratios (IALR) are measured; and rectification and smoothing circuitry is connected between the comparison circuitry and the output device. It will be apparent that the apparatus may be implemented in digital or in analog form.

In human hearing, sound enters the analysis process from the two human ear drums, and the information received by the eardrums can be completely described by the sound pressure at the eardrum surface. Frequency selection—the first step in the sound analysis—takes place on the basular membrane itself. Thus ears are sensitive to band limited signals. The band limited sound is not linearly detected by the membrane, and the actual transfer function is somewhat asymmetric, but can be approximated by an adaptive log function. Thus the output of the basular membrane to the brain is approximately related to the band limited logarithm of the sound pressure present at the eardrum.

The left and right ear signals (already separated into frequency bands) are compared with each other by the brain to determine the direction of the sound. It is known that one of the methods for determining direction involves comparing the levels of sounds at the two ears. Room reflections can alter those levels. In the perception of SI, the level of the band limited signals at the two eardrums—by which is meant the rectified and smoothed amplitudes of the pressure—are not the same and are fluctuating. In the presence of strong room reflections the ear levels can be quite different.

Consider a listener in a reflection-free room with a loudspeaker in front of him or her, and an additional loudspeaker to him or her side which simulates a reflection from the side. The side speaker is driven with the same signal which drives the front loudspeaker, but at a level of −10 dB, and with a variable time delay. Pure sine tones from the two loudspeakers combine at the ears to create an interference, and since the right and left ears are separated by about a 1 ms delay, interference at the two ears is different. The resulting difference in level at the eardrums causes the apparent position of the frontal sound to shift. With pure sine waves, there is no perception of SI. However the levels at the two ears is different, and the difference is surprisingly large and can be as much as 5 dB different with a 400 Hz tone and a reflection at −10 dB depending on the delay chosen for the reflection.

For a 400 Hz tone, about one percent FM modulation at 10 Hz is sufficient to produce an enormous amount of SI and fluctuations in the levels at the two ears if the time delay is greater than about fifteen milliseconds. The amount of SI tends to increase linearly until the modulation reaches about ten percent.

When the fluctuations in level at the two ears are identical in level and in phase, the brain is quite justified in assuming that a single fluctuating sound source produced the sound, and that the source is located in a particular direction. This occurs if the sine wave is AM modulated. When the fluctuations are not in phase, other interpretations are possible. If the fluctuations are very slow—i.e. if the FM modulation is at a one second period or below, the sound source appears to simply move back and forth. The impression is of a moving, but single, sound source. When the modulation speeds up, the speed of the motion of the source back and forth increases—but at some point such a moving source is not reasonable in light of past experience. The brain has obviously learned that many sound sources in the presence of normal room acoustics appear to move rapidly back and forth, and that this apparent motion is a simple artifact of the room acoustics, and not real motion. The brain interprets such signals as a fixed source in the presence of SI.

In accordance with another aspect of the invention, there are provided methods and apparatus for providing an indication of SI by measuring fluctuations in band filtered levels present at two simulated human ears. A process for evaluating spatial impression of an enclosed space includes the steps of generating output signals as a function of fluctuating sound pressure at two points spaced about one-quarter meter apart, band limiting the output signals to a pass band of less than about one octave, generating fluctuating signals that represent amplitude information of the band limited output signals, band limiting the fluctuating amplitude information signals to a pass band of about five hertz to thirty hertz, and comparing the band limited fluctuating amplitude information signals to provide an indication of the spatial impression of the enclosed space. When the levels fluctuate in phase there is little SI, and when they fluctuate out of phase there is a lot. Also if a room has little reflected energy, or if this energy arrives mainly in the medial plane, little SI, and few fluctuations, will be generated. While there are many possible ways these fluctuations could be compared, in a particular embodiment, two log signals derived from the band pass filtered ear drum pressures are subtracted, and the difference rectified for presentation on a meter. In human hearing neither the log signals nor the subtraction is likely to be mathematically precise. In fact, the log function of the basular membrane is known to adapt over a period of a few tenths of a second when large changes in signal level take place. Thus the IALR ratio output may be modified somewhat to match human hearing, for example, with adaptive clipping circuitry.

The resulting IALR measure has a relationship to LF and IACC. If LF is redefined to be essentially the ratio of the lateral energy arriving after ten milliseconds to the total energy the relationship to SI as measured above may be quite good. However, to measure LF this way the impulse response of the room must first be measured. Methods for impulse response measurement tend to be extremely noisy and unpleasant, and thus they are hard to do in the presence of an audience. However, the presence of the audience may change the amount of SI measured a great deal, and it also affect clarity and RT. While IACC can be measured in the presence of an audience, IACC is extremely sensitive to the phases of the signals present at the two ears as a function of the angle of incidence of the sound. In the absence of any reflections, direct sound can create very low or even negative values of IACC if it does not come from directly in front of the listener. It is thus not possible to measure IACC with a broad sound source, and IACC is likely to give misleading results in any sound field.

Figure 2:
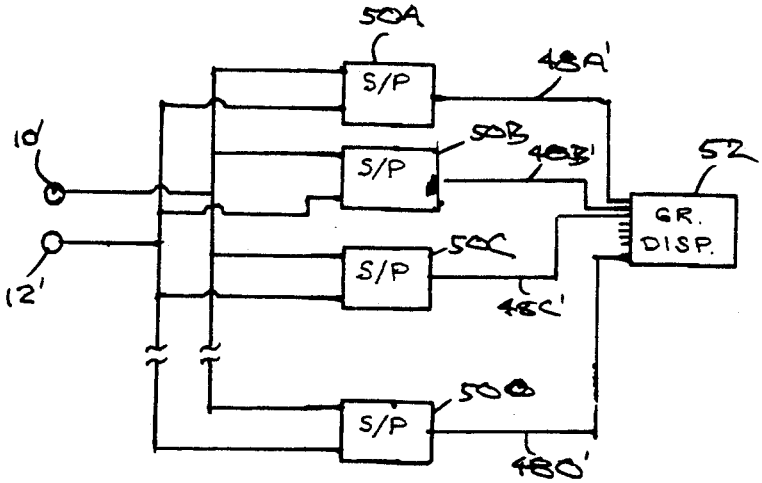

Other features and advantages of the invention will be seen as the following description of particular embodiments progresses, in conjunction with the drawing, in which:

FIG. 1 is a block diagram of a spatial impression meter in accordance with the invention; and FIG. 2 is a block diagram of another system in accordance with the invention.

DESCRIPTION OF PARTICULAR EMBODIMENTS

With reference to FIG. 1, two microphones 10, 12 are separated by about the acoustic distance between the human ears approximately one quarter meter. A dummy head 15 with pinnae may be used to support the microphones if desired. The outputs of microphones 10, 12 are band limited by one third octave (ANSI type 3 (sixth order Chebyshev)) bandpass filters 14, 16, each of which is centered at the same frequency, for example, one kilohertz. The filtered sounds are then rectified by rectifiers 18, 20 and logarithms taken by log circuits 22, 24. The output of each logarithmic detector can be thought of as the instantaneous level of the signal in dB. Adaptive clipper circuitry 26 that includes capacitor 28 and diodes 30, 32 is connected across the outputs of log circuits 22, 24.

The fluctuating level data for both channels 40A, 40B are then band-pass filtered by filters 34, 26, each of which has an upper cut off frequency of about thirty hertz and a lower cut-off frequency of about five hertz. The two signals, one representing the level fluctuations in the right ear, and the other representing the level fluctuations in the left ear are then subtracted by comparator circuit 40.

The output of comparator 40 is the logarithm of the fluctuations in the ratio between the sound pressure in the left ear and the sound pressure in the right ear. The ratio signal is then rectified by rectifier 42, smoothed by filter 44 and applied to meter 46 over line 48.

The meter 46 displays the average fluctuation in the ratio between the sound pressure levels in the left and right ears and provides an indication of the spatial impression of the room, auditorium or other space being analyzed.

In the embodiment shown in FIG. 2, microphones 10', 12' are connected to signal processing units 50A-500, each of which has two channels 40A, 40B, and the outputs of which are applied over lines 48' to graphic display 52. The bandpass filters 14', 16' in each unit 50 are one-third octave ANSI type 3 filters with center frequencies as follows:

| Unit | Center Frequency (Hertz) |
|---|---|
| 50A | 100 |
| B | 125 |
| C | 160 |
| D | 200 |
| E | 250 |
| F | 315 |
| G | 400 |
| H | 500 |
| I | 630 |
| J | 800 |
| K | 1000 |
| L | 1250 |
| M | 1600 |
| N | 2000 |
| O | 2500 |

While particular embodiments of the invention have been shown and described, various modifications will be apparent to those skilled in the art, and therefore, it is not intended that the invention be limited to the disclosed embodiments, or to details thereof, and departures may be made therefrom within the spirit and scope of the invention.

What is claimed is:

1. Spatial impression indicating apparatus comprising two channels, each said channel having a microphone input, a first band pass filter of less than about one octave pass band connected to its microphone input, and circuitry for limiting fluctuating amplitude information in signals from said first band pass filter to frequencies in a band from about five hertz to thirty hertz, said microphones being spaced about one-quarter meter apart and said first band pass filters having the same center frequency, said channels being connected to comparison circuitry for comparing the limited fluctuating amplitude information signals, an output device, and circuitry coupling the output of said comparison circuitry to said output device.

2. The apparatus of claim 1 and further including rectification and smoothing circuitry connected between said comparison circuitry and said output device.

3. The apparatus of claim 1 wherein each said channel includes a rectifier and a log circuit, each said limiting circuitry includes a second band pass filter with an upper limit of about thirty hertz.

4. The apparatus of claim 3 and further including nonlinear adaptive circuitry connected between said two channels.

5. The apparatus of claim 4 wherein said adaptive circuitry includes capacitive and rectifier elements and is connected across the outputs of said log circuits.

6. The apparatus of claim 5 and further including rectification and smoothing circuitry connected between said comparison circuitry and said output device.

7. The apparatus of claim 1 wherein said comparison circuitry is of the subtractor type and its output is a function of fluctuations in the ratio of the levels of the two input signals.

8. The apparatus of claim 7 wherein each said channel includes a rectifier and a log circuit, each said limiting circuitry includes a second band pass filter with an upper limit of about thirty hertz, and said first filter is a one-third octave ANSI band pass filter.

9. The apparatus of claim 8 and further including rectification and smoothing circuitry connected between said comparison circuitry and said output device.

10. The apparatus of claim 9 and further including nonlinear adaptive circuitry connected between said two channels.

11. A process for evaluating spatial impression of an enclosed space comprising the steps of generating output signals as a function of fluctuating sound pressure at two points spaced about one-quarter meter apart, band-limiting said output signals to a pass band of less than about one octave, generating fluctuating signals that represent amplitude information of said band-limited output signals, band-limiting said fluctuating amplitude information signals to a pass band of about five hertz to thirty hertz, and comparing said band-limited fluctuating amplitude information signals to provide an indication of the spatial impression of said enclosed space.

12. The process of claim 11 wherein said step of band-limiting said output signals includes the step of providing a plurality of pass bands, the center frequencies of said plurality of pass bands being offset from one another.

13. The process of claim 11 wherein said step of comparing said band limited fluctuating amplitude signals includes the step of subtracting log signals to provide a ratio of the levels of said output signals to provide said indication of the spatial impression of said enclosed space.

14. The process of claim 13 wherein said step of band-limiting said output signals includes the step of providing a plurality of pass bands, the center frequencies of said plurality of pass bands being offset from one another.

15. Spatial impression indicating apparatus comprising a plurality of signal processing units, each said unit comprising two channels, each said channel having a microphone input, a first band pass filter of less than about one octave pass band connected to its microphone input, and circuitry for limiting fluctuating amplitude information in signals from said first band pass filter to frequencies in a band from about five hertz to thirty hertz, said microphones being spaced about one-quarter meter apart, said channels being connected to comparison circuitry for comparing said limited fluctuating amplitude information signals, the two said first band pass filters of each said unit being tuned to the same center frequency and said first band pass filters of each said unit having a center frequency that is different from the center frequencies of said first band pass filters of all the other said units, an output device, and circuitry coupling the output of said comparison circuitry of each said unit to said output device.

16. The apparatus of claim 15 wherein each said channel includes a rectifier and a log circuit, each said limiting circuitry includes a second band pass filter with an upper limit of about thirty hertz.

17. The apparatus of claim 16 and further including rectification and smoothing circuitry connected between said comparison circuitry and said output device.

18. The apparatus of claim 17 and further including nonlinear adaptive circuitry connected between said two channels.

19. The apparatus of claim 15 wherein said microphone inputs are two microphones coupled to a dummy head with pinnae and the outputs of said two microphones are coupled to each of said signal processing units.

20. The apparatus of claim 19 wherein each said first filter is a one-third octave ANSI band pass filter.

* * * * *

UNITED STATES PATENT AND TRADEMARK OFFICE

CERTIFICATE OF CORRECTION

PATENT NO. : 5,161,197

DATED :November 3, 1992

INVENTOR(S) :David H. Griesinger

It is certified that error appears in the above-indentified patent and that said Letters Patent is hereby corrected as shown below:

The title page, should be deleted to be replaced with the attached title page.

The drawing sheet consisting of Figs. 1 and 2, should be deleted to be replaced with the drawing sheet, consisting of Figs. 1 and 2, as shown on the attached page.

Signed and Sealed this

Twenty-sixth Day of October, 1993

*Attest:*

*Attesting Officer*

BRUCE LEHMAN

*Commissioner of Patents and Trademarks*

US005161197A

United States Patent [19]

Griesinger

[11] Patent Number: 5,161,197

[45] Date of Patent: Nov. 3, 1992

[54] ACOUSTIC ANALYSIS

[75] Inventor: David H. Griesinger, Cambridge, Mass.

[73] Assignee: Lexicon, Inc., Waltham, Mass.

[21] Appl. No.: 787,532

[22] Filed: Nov. 4, 1991

[51] Int. Cl.[5] ..... H04R 29/00; H04R 5/027

[52] U.S. Cl. ..... 381/56; 381/26

[58] Field of Search ..... 381/1, 26, 92, 56, 63

[56] References Cited

U.S. PATENT DOCUMENTS 3,626,365 12/1971 Press ..... 381/92
4,135,203 1/1979 Friedman ..... 381/1
5,029,216 2/1991 Jhabvala et al. ..... 381/26

OTHER PUBLICATIONS

Bradley, Contemporary Approaches to Evaluation Auditorium Acoustics, AES 8th International Conference, pp. 59-69.

*Primary Examiner*—Forester W. Isen
*Attorney, Agent, or Firm*—Fish & Richardson

[57] ABSTRACT

A process for evaluating spatial impression of an enclosed space includes the steps of generating output signals as a function of fluctuating sound pressure at two points spaced about one-quarter meter apart, band limiting the output signals to a pass band of less than about one octave, generating fluctuating signals that represent amplitude information of the band limited output signals, band limiting the fluctuating amplitude information signals to a pass band of about five hertz to thirty hertz, and comparing the band limited fluctuating amplitude information signals to provide an indication of the spatial impression of the enclosed space.

20 Claims, 1 Drawing Sheet

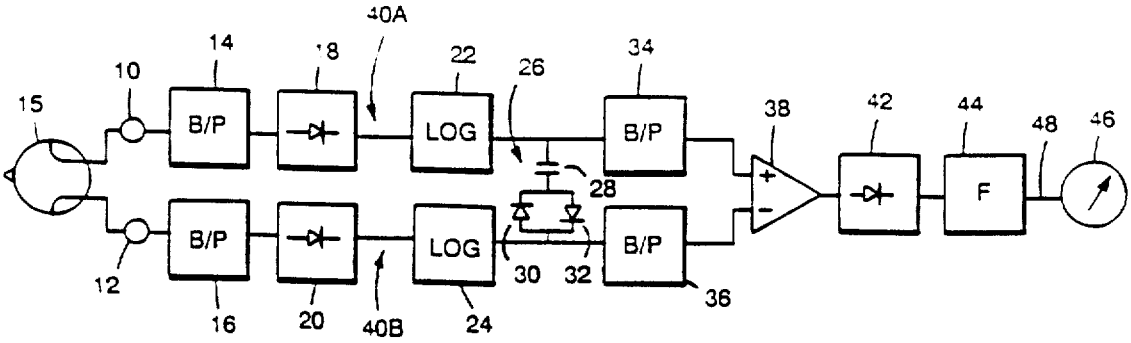

UNITED STATES PATENT AND TRADEMARK OFFICE

CERTIFICATE OF CORRECTION

PATENT NO. : 5,161,197

DATED : November 3, 1992

INVENTOR(S) : David H. Griesinger

It is certified that error appears in the above-indentified patent and that said Letters Patent is hereby corrected as shown below:

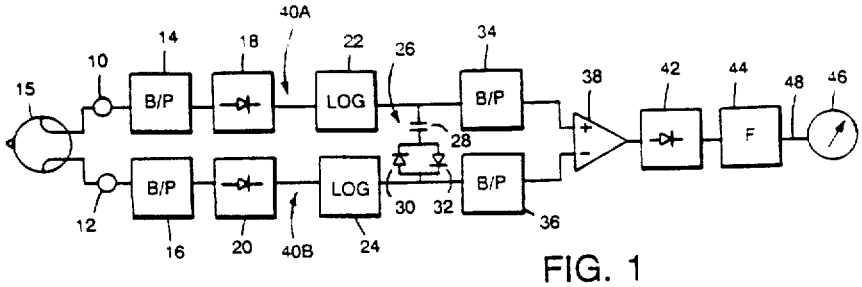

FIG. 1

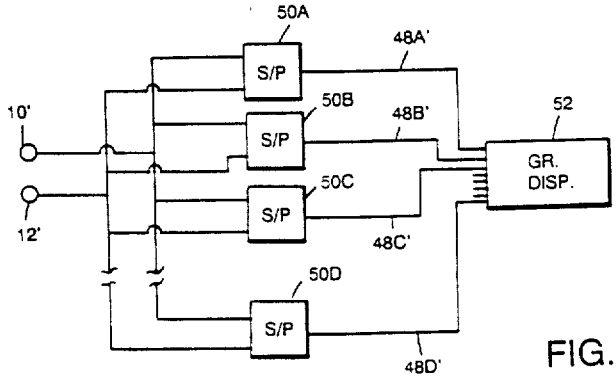

FIG. 2